US005293000A

United States Patent [19]

Adinolfi

[11] Patent Number: 5,293,000

[45] Date of Patent: Mar. 8, 1994

[54] ELECTRONIC PERCUSSION SYSTEM SIMULATING PLAY AND RESPONSE OF ACOUSTICAL DRUM

[76] Inventor: Alfonso M. Adinolfi, 9016 Red-Wood Rd., Redmond, Wash. 98052

[21] Appl. No.: 935,047

[22] Filed: Aug. 25, 1992

[51] Int. Cl.[5] ..... G10H 3/12

[52] U.S. Cl. ..... 84/730; 84/DIG. 12; 84/DIG. 24

[58] Field of Search ..... 84/723–746, 84/DIG. 12, DIG. 24

[56] References Cited

U.S. PATENT DOCUMENTS

| | | | |
|---|---|---|---|
| 3,725,561 | 4/1973 | Paul . | |
| 4,226,156 | 10/1980 | Hyakutake . | |
| 4,279,188 | 7/1981 | Scott . | |
| 4,581,973 | 4/1986 | Hoshino . | |
| 4,947,725 | 8/1990 | Nomura . | |
| 4,984,498 | 1/1991 | Fishman . | |
| 5,105,710 | 4/1992 | Rothmel | 84/730 |

FOREIGN PATENT DOCUMENTS

3022770 A1 12/1981 Fed. Rep. of Germany .

*Primary Examiner*—Stanley J. Witkowski

*Attorney, Agent, or Firm*—Graybeal Jackson Haley & Johnson

[57] ABSTRACT

An electronic percussion system having the look, feel and response of an acoustic drum is provided by a combination of a drum body shell, conventional drum heads held at adjustable tension across open ends of the shell, and within the interior drum cavity a sound-to-electrical transducer is embedded in layers of rubber foam filler material. The sound energy attenuating characteristics of the foam filler material prevent the transducer from being falsely triggered by ambient sound exterior to the drum, by sympathetic vibrations of the drum, and resists false triggering due to lightly, inadvertently hitting the drum stand. In a bass drum embodiment, the transducer is mounted directly between layers of low density rubber foam, while a snare and tom drum configuration includes a thin sound plate that floats between layers of rubber foam and to which the transducer element is mounted to excite the transducer by capturing sound energy from the striking head while selectively discriminating against other ambient sounds and sympathetic vibration.

15 Claims, 3 Drawing Sheets

ELECTRONIC PERCUSSION SYSTEM SIMULATING PLAY AND RESPONSE OF ACOUSTICAL DRUM

BACKGROUND OF INVENTION

The invention relates to improvements in electronic drums and in particular to a new electronic percussion system that simulates the look, feel and play response of an acoustical drum.

Following the success of electric keyboards and guitars, innovators have created the electronic counterparts of other acoustical instruments, including drums. Electronic percussion instruments for outputting electrical signals that trigger synthesized drum sounds are now often used by musicians seeking the advantages of a controlled output, namely, an electrical signal that can be channeled to the desired downstream equipment and eventual application to loudspeakers, tape recordings, transmitters or other utilizing equipment. By converting the player's performance through the use of electronic sensor pads into an electrical signal, the output can be more easily managed than "miking" the direct acoustical output of traditional drums. In providing the electronic counterpart of acoustical drums, small circular resilient pads are often used to convert the strike of the player's drumsticks into electronic impulses that are in turn converted into synthesized drumlike sounds that are under the control of the audio engineer. The electronic drum pads represent one kind of electronic percussion instrument for creating the synthesized drum sounds. An example of the electronic drum pad is found in U.S. Pat. No. 4,947,725. Typically they are made with stretched skin backed by a light density foam material over a transducer sound board. While electronic pads of this kind have enjoyed a following among musicians and audio engineers, there is a definite disadvantage to the player in that the look, feel and response of the pads fails to give the drummer the same response rhythm that a traditional acoustic drum provides. Since drummers learn their musical talent from acoustic drums, the changeover to electronic pads may be unacceptable to some performers and less than optimum for others. The disadvantages are primarily in the feel of the sticks a they strike the simulated drum surface and, in the drummer's motor memory in reaching for the usual placement and strike area of conventional acoustic sets. Thus far, the pads have not been able to provide the same feel and texture as the drum heads of the acoustic snare, tom and bass.

In another type of known electronic drum, an external sensor is mounted to contact the acoustical drum head and pick up its vibration, sending the resulting signal to the utilization electronics. The intent there is to provide the drummer with a realistic acoustic drum feel and yet provide a controllable electronic signal for downstream mixing, recording and application to live performance speakers. Such externally triggerable sensors used in combination with modified acoustical drum heads did provide the desired feel to the player's sticks but had the disadvantage of being extremely susceptible to false triggering due to inadvertent light hits on the drum heads, rims, or other parts of the drummer's set up, and picking up sympathetic vibration due to ambient sound from other drums, instruments, or loud speakers in the vicinity. The sudden spurious triggered output from the drum synthesizer could ruin a performance or recording. An example of such an externally trigger percussion sensor is shown in U.S. Pat. No. 4,984,498.

SUMMARY OF THE INVENTION

Accordingly, it is an object of the present invention to provide a new electronic percussion system for achieving the advantages of an electronically synthesized or generated drum sound while allowing the performer and audience to enjoy the realistic look, feel and response of traditional acoustic drums. Thus, in accordance with the preferred embodiment of the invention, an electronic percussion system having the look and feel of an acoustic drum is provided by the combination of a drum body shell having an opening for receiving thereacross a drum head, preferably under tension, and forming therewithin a drum cavity. A sound energy attenuating filler occupies substantially all the free space within the drum cavity and provides a unique sound absorbing medium in which a sound-to-electrical transducer is embedded, spaced from any direct contact with the drum shell or drum head. By surrounding the transducer with the sound attenuating filler, such as a light to medium density rubber or urethane foam, this novel electronic percussion instrument faithfully converts the player's striking of the drum head into electrical triggering impulses that are then converted by downstream electronics into synthesized drum or other desired output sounds. Most importantly, the components of the overall drum assembly, including the sound energy attenuating foam filler and location of the transducer, such as a piezoelectric sensor, embedded within the filler virtually eliminates false triggering of the electronics due to inadvertent hitting of the drum assemblies or picking up ambient sound energy from nearby instruments, including other drums in a set, or from loudspeakers, and without loss of sensitivity or dynamic range control when sticking the head.

In a preferred embodiment, the filler is an elastomeric foam material of low to medium density such as a foam of synthetic rubber or a urethane foam. The drum shell is preferably of a solid or ply hardwood, and, in the case of a snare or tom drum, a wood sound plate is also embedded so as to float within the elastomeric foam filler to excite the relatively smaller piezoelectric transducer assembly with drum head strikes without being falsely triggered by spurious sound, sympathetic vibration, and being resistant to light, inadvertent hits on the drum. For a simulated bass drum, the piezoelectric transducer is embedded between sheets of foam filler without the sound board plate and the transducer in that case is offset from the predefined strike area of the base drum beater.

Another preferred feature of the drums is the placement of a layer of denser elastomeric material, such as a closed cell foam or neoprene layer that is placed adjacent the non-struck drum head to prevent sound energy from being coupled through the bottom or non-struck drum head to the transducer. The remaining components of the electronic drum may use conventional parts including the drum heads themselves which are in turn held in place and tensioned to a desired stick feel by tensioning screws pulling the rims into circumferentially mounted mid-body lugs. For decorative purposes, a plastic wrap or other decorative material may be placed around the exterior of the wooden drum body shell underlying the rims, tensioning screw, and lugs. The result is a percussion system that has the appearance of a conventional acoustic drum which has the physical response, sensitivity, and feel close to that of an acoustic drum. When played without the electronic synthesizing and amplification, these drums sound like the muffled quietness of practice pads, and when played with the power of amplified synthesized electronics, there is no false triggering that can impair or detract from a performance or recording.

The components and operation of these simulated electronic drums provides an easily manufactured, readily reparable, reliable musical system that combines the advantages of an acoustic drum set with all the desirable characteristics of synthesized sound.

These and further features, objects and advantages of the invention will become apparent to those skilled in the art from the following detailed description and dependent drawings.

DETAILED DESCRIPTION OF EMBODIMENTS

Figure 1:
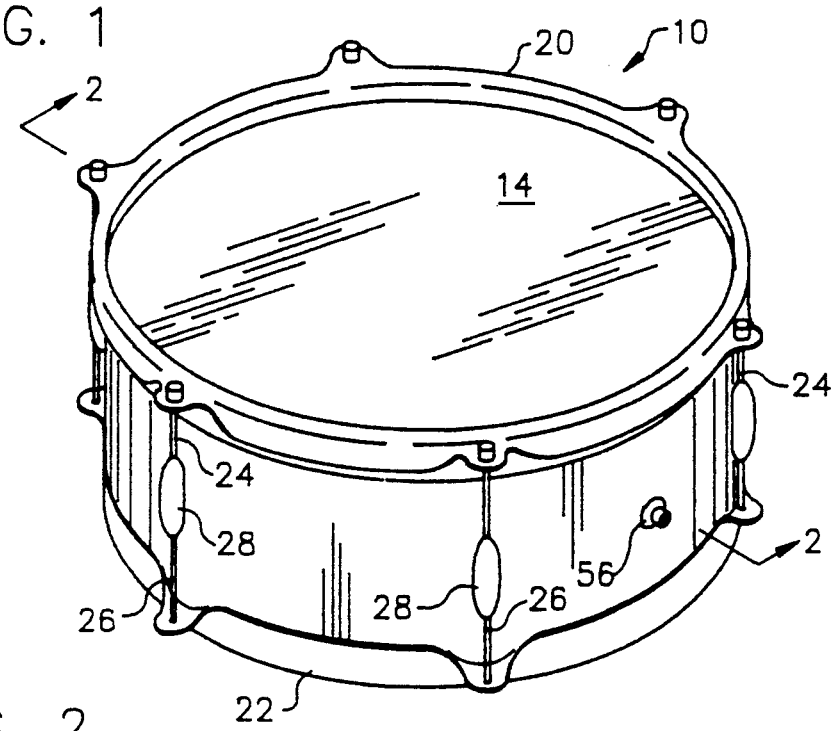
FIG. 1 is a perspective view of one embodiment of the invention showing the external appearance of a tom drum body and striking head of a tom drum.
Figure 2:
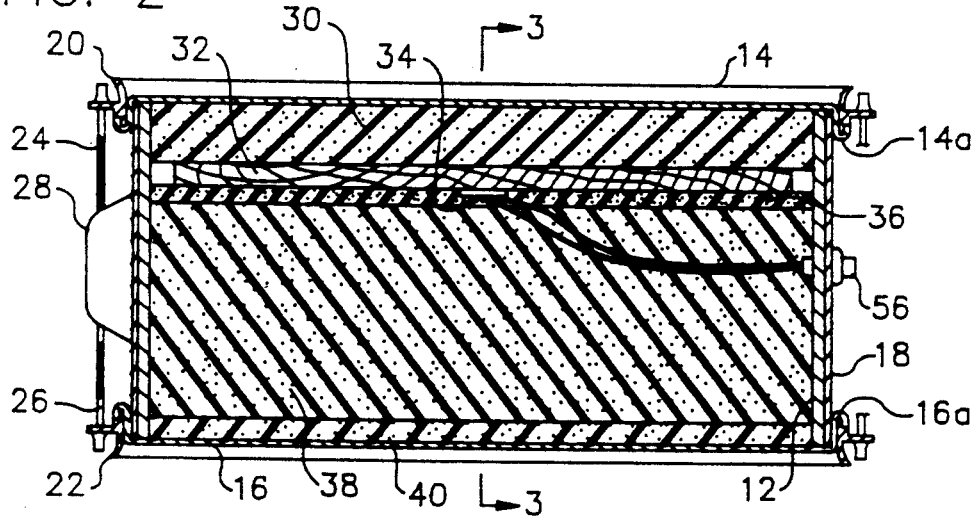
FIG. 2 is a vertical section through the diameter of the tom drum of FIG. 1 illustrating the internal transducer mounted to a sound plate of wood both embedded and floating in sound attenuating filler material of an elastomeric foam.
Figure 3:
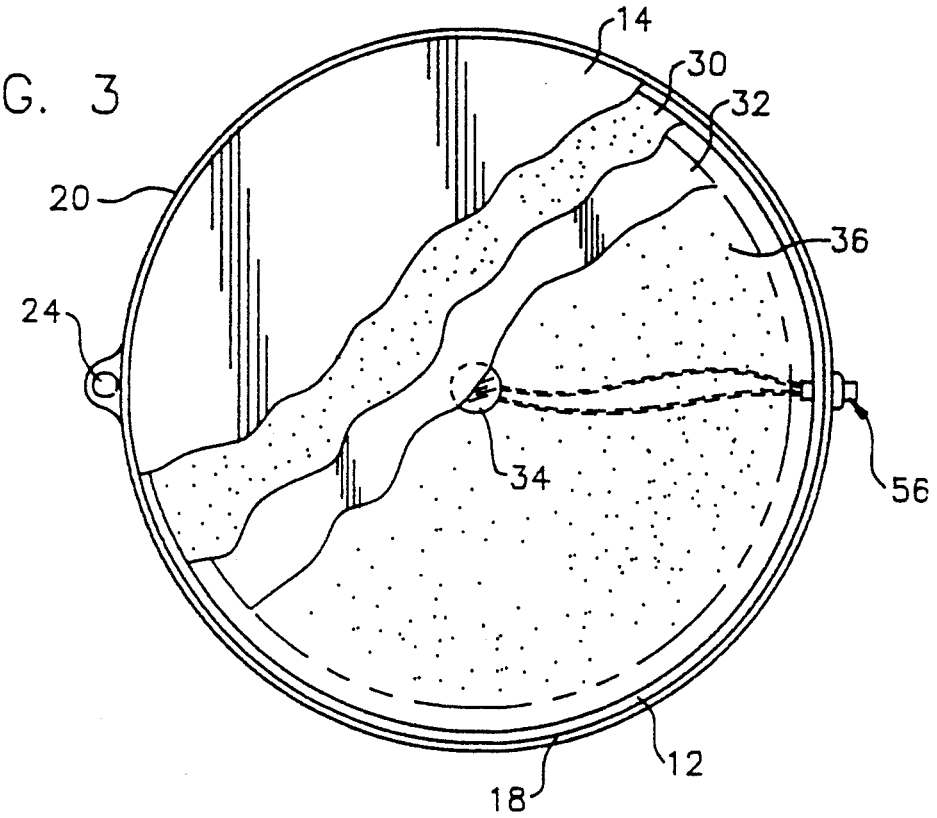
FIG. 3 is a top elevation view of the tom drum of FIGS. 1 and 2 showing a cutaway of the head, upper layer of foam, and wooden sound plate to expose the piezoelectric transducer assembly and the lower portions of the foam filler material.

In a preferred embodiment of a snare and tom drum, the electronic percussion system of the present invention is implemented as shown in FIGS. 1–4 to have the external appearance of a conventional acoustic drum 10 but incorporating within the drum cavity a vibration attenuating filler, primarily of relatively low and medium density elastomeric foam and a piezoelectric transducer uniquely arranged to selectively, electronically respond to direct striking of the drum head while remaining electronically quiet without false triggering in the presence of other sources of sound energy and sympathetic vibrations. Also, the system is resistant to triggering when the shell, rim, stand and other accessories are inadvertently lightly hit, although the drum should and does trigger when intentionally forcefully struck on the rim, shell or lugs. The snare and tom configurations are essentially the same and are represented by the internal construction of snare drum 10 shown in FIGS. 2, 3 and 4 and described as follows. The drum frame or body is a hollow wooden cylindrical shell 12 (FIGS. 2 and 3), to which a striking drum head 14 and an opposed lower drum head 16 are disposed across the open axial ends of the cylindrical shell 12. A decorative, relatively thin plastic or other material wrap 18 may be provided about the outer circumferential wall of shall 12, as shown in FIGS. 2 and 3, and the entire assembly is held in place by conventional head hoops or rims 20 and 22 and circumferentially spaced pairs of inline tensioning screws 26 and cooperating retaining lugs 28. For simplification, only one set of screws and lugs are shown in FIGS. 2 and 3. The striking head 14 and bottom head 16 each have a circumferential edge bead **14*a* and 16*a*, respectively, which is engaged by a shoulder of tensioning rims 20 and 22, respectively, to stretch heads 14 and 16 across the axial end openings of shell 12 to a desired tension control by adjusting screws 24 and 26** in the same manner as an acoustical drum is tuned.

Unlike an acoustical drum, however, the interior cavity formed by the inner circumferential wall of shell 12 and the spaced parallel inner surfaces of striking head 14 and bottom head 16 is a vibration attenuating filler. This filler is primarily a low and/or medium density resilient foam, such as synthetic sponge rubber or urethane foam, filling the entire cavity to dampen vibrations of heads 14 and 16 and attenuate any internal sound energy resonance. Embedded therewithin is a sound-to-electrical transducer spaced away from heads 14 and 16 and shell 12 by the intervening foam filler material. Also, in the preferred embodiment of the snare and tom drums shown in FIGS. 1–4, a sound plate, preferably of wood, is embedded and floated with the transducer attached in the foam filler material to provide optimum sensitivity and dynamic range response of the transducer to the striking of drum head 14.

Figure 4:
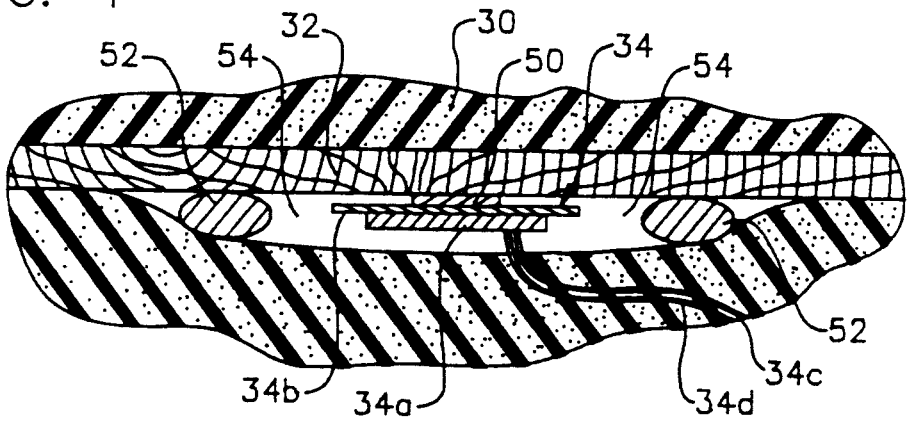
FIG. 4 is an enlarged sectional detail view of the piezoelectric transducer assembly, wooden sound plate, and adjacent layers of elastomeric foam material.

Thus, with reference to FIGS. 2, 3 and 4, the interior cavity of drum 10 includes a replaceable layer of resilient, relatively low density foam 30 underlying the striking head 14, followed by a floating disc shaped sound plate 32, and a sound-to-electrical transducer 34 mounted to the underside of plate 32, that faces away from striking head 14, a medium density rubber foam layer 36 followed by a relatively thicker body of low density rubber foam 38 filling the major portion of the drum cavity, and finally, a closed-cell neoprene layer 40 resting against the bottom drum head 16. The drum heads are conventional acoustic heads of synthetic flexible sheet material or animal skins.

As illustrated, the relatively thicker (measured axially) low-density form layer 38 disposes sound plate 32 and attached transducer 34 in about the upper one-third of the cavity closer to striking head 14 than bottom head 16. By way of example, in a snare or tom drum assembly of drum shell diameters of 12" to 22", and a drum cavity of about 4½" deep measured axially between heads 14 and 16, the following relative thicknesses of the various layers have been found suitable. The top low density foam layer 30 is a 60 Duro commercial grade foam rubber and may be replaced after a period of wear due to the repeated compression it is subjected to between drum head 14 and plate 32, and here is ½" thick. Wooden sound plate 32, which may also be of other substantially rigid yet sheet compliant material, including thin metal, plastic, hardened epoxy or other synthetic substance with or without fiber reinforcement, is here 3/16" thick and has a diameter that approximates that of the head but is undersized by about 85–95% relative to the interior diameter of shell 12 in order to prevent edge contact of plate 32 with shell 12. This is so that no direct shell vibrations or shell hits are coupled by direct transmission to transducer 34. Layer 36 is ⅛" thick and is provided by a medium density sponge rubber foam of 5 to 9 pounds compressibility. The thicker filler layer 38 is again another low density rubber foam of 60 Duro density. The lowermost neoprene layer 40 has a 3/16" thickness. All of the resilient foam, rubber or neoprene layers 36, 38 and 40 have a diameter that provides a snug circumferential fit inside the interior diameter of wooden shell 12 to provide optimum dampening of internal resonance and other trapped sound energy. To further absorb and/or dissipate sound energy that otherwise might cause false triggering, the body shell 12 is a 6-ply veneer hardwood which has proven to work better than metal or plastic shells. Maple, birch or mahogany are preferred.

With reference to FIG. 4, in the construction of the internal components of electronic drum 10, the wood sound plate 32, transducer 34, medium density foam layer 36, low density thick foam layer 38 and neoprene layer 40 are all secured together in a sandwich by a silicone adhesive. The transducer 34 itself is a piezoelectric assembly available from a number of sources, including Kyecero Company as their element KBS-35DA-3A, and consists of a piezoelectric element **34*a* mounted on a somewhat larger diameter metal disk 34*b* and having leads 34*b* and 34*d*** soldered or brazed to the transducer components. More particularly, the piezoelectric transducer used in this embodiment has the following manufacturer specifications: element thickness 0.53 mm; metal thickness 0.25 mm; electrode diameter 23.5 mm; impedance 200 ohms; and frequency 2.8 kHz–0.5 kHz. Other commercially available sensors, including various piezoelectric transducers, may be used for the triggerable sound pick up.

To mount transducer 34 to sound plate 32, it is preferred that an attachment means be used that allows the metal disk **34*b* to have a degree of vibrational freedom in its embedded placement between sound board 32 and the medium density foam layer 36. For this purpose, a small piece of double backed adhesive foam 50 having an attachment surface of less than one half that of the area of metal transducer disk 34*b* has been found to provide the desired degree of vibrational freedom of the transducer as well as permit a cost effective way of assembling the system. The thickness of double backed adhesive tape element 50 is about 1/16" and is located substantially concentric of the transducer metal disk 34*b* with the piezoelectric element 34*a* facing away from tape element 50 and sound plate 32 as shown best in FIG. 4. The area of wood plate 32** that receives the transducer is varnished beforehand to provide a good adhesive bonding surface.

Figure 7A:
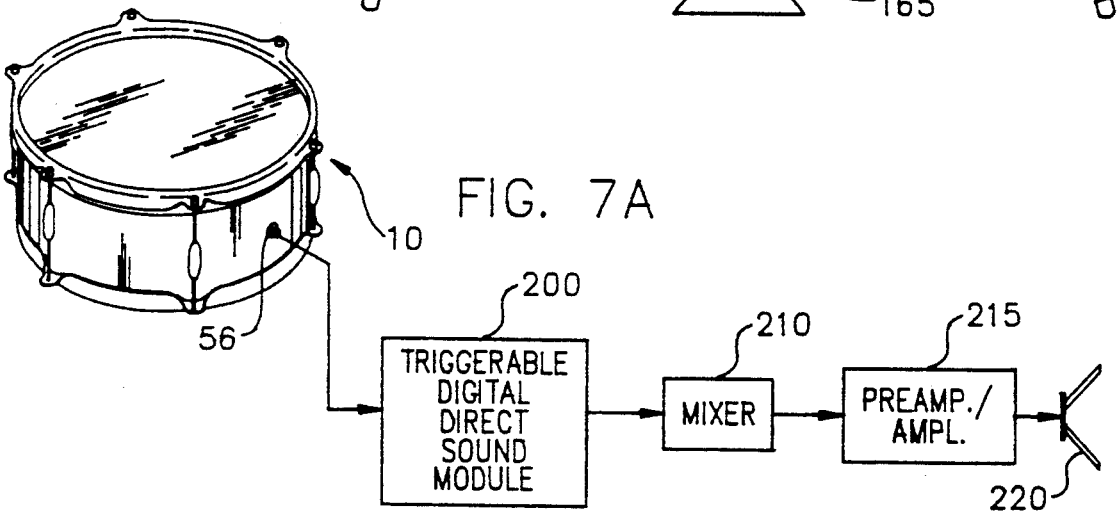
FIG. 7A shows the simulated tom drum of FIGS. 1–4 having the transducer output jack linked by cable to typical utilization electronics, here including a triggerable digital direct sound module, mixer, pre-amp/amplifier and speaker.
Figure 7B:
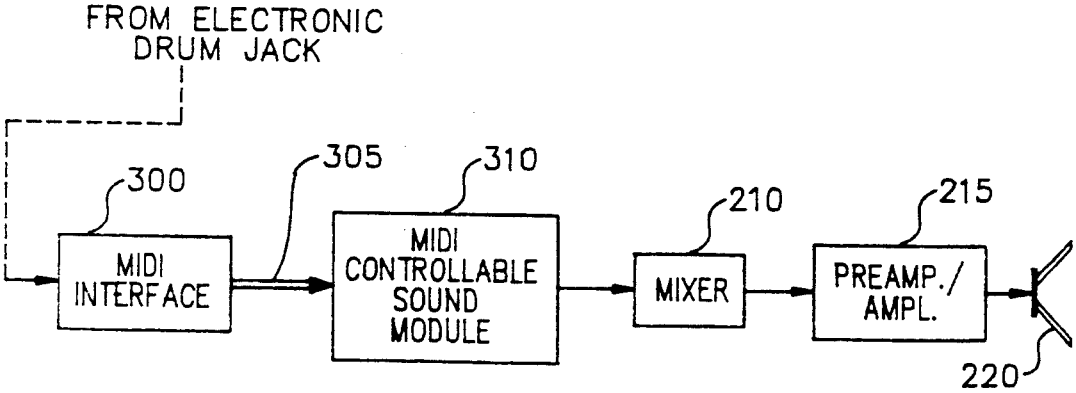
FIG. 7B shows alternative utilization electronics connecting the transducer output jack of the electronic drum to a MIDI interface and thence to a MIDI controllable sound module followed by a mixer, preamplifier and loudspeaker.

To provide a further degree of vibrational freedom of transducer 34 in the above described assembly, the adjacent faces of sound plate 32 and medium density foam layer 36 are held together by a half dozen dollops of silicone adhesive 52, again as best illustrated in FIG. 4, in which the dollops are placed away from the immediate vicinity of transducer 34 and are approximately of a thickness that when cured results in a gapped spacing 54 between plate 32 and the upper surface of foam layer 36 to allow unrestricted vibration of transducer 34 as illustrated. In other words, the dollops of cured silicone which, when cured, remain in a firm but resilient state, hold foam layer 36 away from plate 34 by a sufficient amount to prevent excessive dampening of the vibration of the transducer disk. The size of silicone adhesive dollops 52 is on the order of ¾" to 1" in diameter and 1/16" thick. Extending from transducer 34, leads **34*c* and 34*d*, which may be individual wires or a section of coaxial cable, pass through the foam filler such as may be made by boring through the foam rubber or by threading the leads through the foam rubber to extend them to the terminals of a standard ¼" audio jack assembly 56 mounted on shell 12 and passing through the plastic cosmetic wrap 18 as illustrated. From jack 56, the electrical signals produced by transducer 34 in response to striking drum head 14 are fed to conventional downstream electronics, as shown in FIGS. 7A and 7B**, to produce synthesized audio output.

In using electronic drum 10, the heads 14 and 16 are arranged and adjusted to the drummer's feel in the customary manner of an acoustical drum by tightening or loosening screws 34 and 36 about the circumference of the drum shell. The stick response of the drum is very close to the acoustical counterpart, except the compression of the foam rubber against the drum heads does dampen the bounce-back response of the drum head slightly. Nevertheless, the stick response of drum 10 is much closer to the actual acoustic drum than most electronic percussion pads that are typically used by synthesized drum sounds, and the placement and size are the same as the acoustics. Moreover, the assembly of drum 10 as described above does not produce false triggering of transducer 34 due to sympathetic vibration because of the unique assembly of sound attenuating, dampening and absorbing materials, principally the low and medium density rubber foams within the drum cavity and the embedding of the transducer, and, in this embodiment, a sound board within the foam filler.

Figure 5:
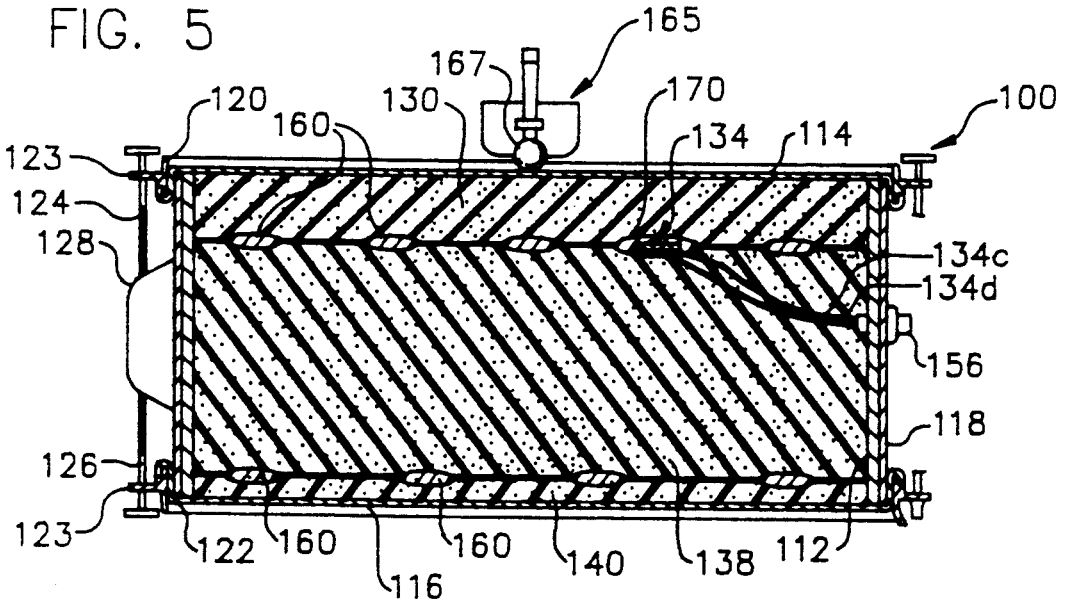
FIG. 5 is a sectional view similar to FIG. 2, showing an embodiment of the invention used as a simulated bass drum.
Figure 6:
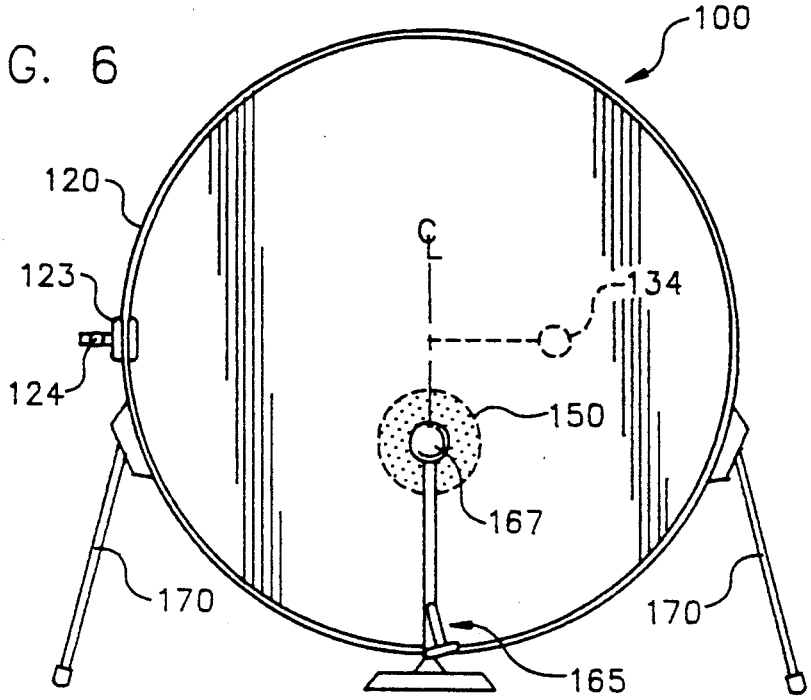
FIG. 6 is a rear elevation view (as viewed by the drummer) of the bass simulated electronic drum of FIG. 5 associated with a conventional floor mounted, foot actuated beater and illustrating in dotted lines the predetermined region of the drum head struck by the beater.

Now with reference to FIGS. 5 and 6, an alternative embodiment of the electronic percussion system of the invention is shown embodied as a bass drum 100 having a construction that, unless otherwise stated, corresponds to the above described components and assembly of the electronic drum 10 of FIGS. 1–4. Thus, in FIG. 5, a cylindrical wood ply shell 112 has a batter head 114 and a front head 116 stretched across open axial ends of shell 112. Conventional head tensioning rims 120, 122 are provided with spaced circumferential tensioning assemblies including hook brackets 123 and adjusting screw assemblies 124 and 126 (only one set is shown for simplicity) that extend alongside the exterior wall of the drum body into complementary threaded in line bores of lugs 128 in a conventional per se manner. A plastic or other material wrap 118 may be provided for cosmetics.

Within the cavity formed by shell 112 and opposed heads 114 and 116 is the sponge rubber foam filler material, in this case including a relatively thick main body layer 138 and a layer of lesser thickness 130. Between these two layers is the sound-to-electrical transducer 134 embedded to place the transducer in a region that is closer to beater head 114 than front head 116 and offset for preferred response in a vertical plane from a predetermined beater strike area 150, as shown in FIG. 6. In a preferred embodiment, the ratio of thickness of foam filler layers 130 and 138 is 1.5:6.5 or approximately a ratio of 1:6. The final filler layer is preferably a closed-cell ¼" thick neoprene layer 140 which, as in the case of layer 40 of electronic drum in FIGS. 1–4 blocks sympathetic vibrations impingent on front head 116 from being transmitted and triggering the transducer. The various filler layers 130, 138 and 140 are held together by dollops of silicone adhesive 160, and in this embodiment the transducer assembly, including the metal disk and piezoelectric element is held in a bed of silicone adhesive 170. Leads 134*c* and 134*d* extend to terminals of a conventional jack 156 as in the case of drum 10 for connection to the sound generating electronics. As best shown in FIG. 6, bass drum 100 is mounted on its side with conventional leg stands 170 and the foot actuated beater assembly 165 stands on the floor positioning the beater head 167 in the strike region 150. As illustrated in FIG. 6, transducer 134 is located in the vertical plane offset from a center line passing through the center of the beater strike zone 150 and preferably is placed in that offset position along the horizontal diameter of the drum assembly.

Now with reference to FIGS. 7A and 7B, two alternative, conventional electronic sound generating setups are illustrated. In FIG. 7A, drum 10 has jack 56 connected by a cable to a conventional synthesizer called a triggerable digital direct sound module 200, which then has an output into a conventional mixer 210 followed by a preamp/amplifier module 215, which drives a loudspeaker 220. Alternatively, the preamp/amplifier can be fed to any common utilization device including a tape or other recording system or a modulator of a radio transmitter. Examples of triggerable digital direct sound module 200 include synthesizer products available from manufacturers including Alesis, Roland, Yamaha, or Kat.

The transducer output from electronic drum 10 may also be fed first to a MIDI interface 300, shown in FIG. 7B, and then through a digital output 305 to a MIDI controlled sound module 310, which in turn is fed through a mixer 210, and preamp/amplifier 215 driving a loudspeaker 220 as in the case of the electronics of FIG. 7A. MIDI interfaces and MIDI controlled sound modules 300, 310 are conventional systems that receive the electrical output signal of the drum transducers used in drums 10 and 100 to produce a digital signal representing the transducer output that in turn causes the controllable sound module 310 to produce predetermined synthesized sound signals all in a manner known per se.

While only particular embodiments have been disclosed herein, it will be readily apparent to persons skilled in the art that numerous changes and modifications can be made thereto, including the use of equivalent means, devices and methods, without departing from the spirit of the invention.

I claim:

1. An electronic percussion device having the appearance and strike response of an acoustic drum, comprising:

a cylindrical drum body shell having open ends;

a striking drum head mounted in stretched condition across one of said open ends and a lower drum head mounted in stretched condition across the other open end and thereby forming a drum cavity bounded by the interior surfaces of said shell and heads;

a sound energy attenuating elastomeric foam filler in said cavity; and a sound-to-electrical transducer means disposed within said filler and being spaced from said drum head and drum shell so that no direct mechanical energy is coupled from said head or shell to said transducer means, whereby said cylindrical shell body and drum heads have the stick response and appearance of an acoustic drum.

2. The electronic percussion device of claim 1, wherein said elastomeric foam material comprises a foam rubber or foam urethane.

3. The electronic percussion device of claim 1, further comprising a sound plate arranged within said cavity substantially parallel to said drum heads and spaced therefrom by a substantial thickness of said sound energy attenuating elastomeric foam filler, and wherein said transducer means is disposed adjacent said sound plate facing away from said striking drum head.

4. The electronic percussion device of claim 3, wherein said plate has a circumferential edge spaced from an interior surface of said drum shell.

5. The electronic percussion device of claim 4, wherein said plate is a wood disk having at least one substantially smooth surface and is separated from said striking drum head by a layer of foam rubber.

6. The electronic percussion device of claim 5, wherein said transducer comprises a flat piezoelectric sensor mounted substantially at the center of said plate.

7. The electronic percussion device of claim 6, wherein said piezoelectric sensor is fastened to said plate by a pad of elastomeric foam material in which one face of the pad is adhered to the plate and the other face of the pad is adhered to the piezoelectric sensor.

8. The electronic percussion device of claim 7, wherein said pad is sized to be less than that of said piezoelectric sensor in the dimension parallel to said plate so that the outer extent of said piezoelectric sensor projects beyond the outer perimeter of said pad so as to lessen the amount of mechanical restriction on vibrating motion of the piezoelectric sensor.

9. The electronic percussion device of claim 1, further comprising a layer of neoprene disposed within said cavity face-to-face with the interior surface of said lower drum head and separated from said transducer means by a relatively thicker layer of foam rubber.

10. The electronic percussion device of claim 9, wherein said wood shell is made of a plywood having at least one hardwood veneer.

11. The electronic percussion device of claim 1, for use as a bass drum, wherein said sound attenuating filler comprises a foam rubber that substantially fills said drum cavity, and wherein said transducer means is embedded in said foam rubber at a position spaced interiorally from said striking drum head and drum shell and offset in a direction toward the interior shell body from a predefined base drum beater strike area.

12. The electronic percussion device of claim 1, for use as a bass drum, wherein said filler comprises at least first and second layers of foam rubber disposed in said cavity having planar surfaces parallel to said drum head, and wherein said transducer means is embedded between abutting planar surfaces of said layers of foam rubber and is held in place by an adhesive.

13. The electronic percussion device of claim 12, wherein said adhesive comprises a synthetic material having permanent resiliency.

14. An electronic drum, comprising:

a cylindrical drum shell having openings at opposite axial ends;

a drum head stretched across one of said shell openings;

rim tensioning means mounted on said shell for adjustably tensioning said drum head;

a sound energy attenuation foam material substantially filling a cavity defined by said drum shell and drum head;

a sound-to-electrical transducer means embedded in said foam material in spaced apart relation from said drum head and drum shell; and sound signal synthesizing means electrically coupled to said transducer.

15. An electronic percussion device having the look and feel of an acoustic drum, comprising:

a cylindrical drum body shell having open ends;

a striking drum head mounted in stretched condition across one of said open ends and a lower drum head mounted in stretched condition across the other open end and thereby forming a drum cavity bounded by the interior surfaces of said shell and drum heads;

rim mounted head tensioning and adjustment means disposed circumferentially of said cylindrical drum body shell and being adjustable to hold and tighten to a desired tension said striking drum head and said lower drum head in said stretched conditions respectively across said open ends of said cylindrical drum body shell;

a sound energy attenuating elastomeric foam filler in said cavity; and sound-to-electrical transducer means disposed within said filler and being spaced from said drum head and drum shell so that no direct mechanical energy is coupled from said head or shell to said transducer means, whereby said cylindrical shell body and drum heads have the stick response and appearance of an acoustic drum.

* * * * *